US010443796B2

(12) United States Patent
Liu et al.

(10) Patent No.: US 10,443,796 B2
(45) Date of Patent: Oct. 15, 2019

(54) LED STRIP LAMP LIGHT DISTRIBUTING SYSTEM HAVING A LIGHT SOURCE MODULE AND A REFLECTIVE DEVICE WITH VARIOUS CURVATURES FOR ILLUMINATING DIFFERENT SECTIONS OF AN ILLUMINATED SURFACE

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Xiaoyun Liu, Zhejiang (CN); Jianguo Dong, Zhejiang (CN); Zuping He, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/990,390

(22) Filed: May 25, 2018

(65) Prior Publication Data

US 2018/0335187 A1 Nov. 22, 2018

(30) Foreign Application Priority Data

May 18, 2017 (CN) ..... 2017 1 0353968

(51) Int. Cl.

| | |
|---|---|
| ***F21S 4/28*** | (2016.01) |
| ***F21K 9/23*** | (2016.01) |
| ***F21K 9/68*** | (2016.01) |
| ***F21S 2/00*** | (2016.01) |
| ***F21V 7/05*** | (2006.01) |
| *F21Y 115/10* | (2016.01) |

(52) U.S. Cl.

CPC ..... *F21S 4/28* (2016.01); *F21K 9/23* (2016.08); *F21K 9/68* (2016.08); *F21S 2/005* (2013.01); *F21V 7/05* (2013.01); *F21Y 2115/10* (2016.08)

(58) Field of Classification Search

CPC ..... F21Y 2115/10; F21Y 2103/10; F21V 7/0008; F21V 7/0016; F21V 7/005; F21W 2131/406; F21W 2161/405; F21W 2131/107; F21W 2131/103; F21W 2131/101

See application file for complete search history.

(56) References Cited

U.S. PATENT DOCUMENTS 8,721,131 B2 * 5/2014 Miyairi ..... F21V 7/0008 362/217.05
10,222,026 B2 * 3/2019 Kim ..... F21S 8/04

* cited by examiner

*Primary Examiner* — Robert J May
(74) *Attorney, Agent, or Firm* — Wang Law Firm, Inc.

(57) ABSTRACT

A light distribution system of an LED strip lamp, comprising a light source module, a reflective device disposed in a light-emitting direction of the light source module, and an illuminated surface which receives the reflected light from the light reflective device, the illuminated surface includes a ground surface and a main illuminated surface perpendicular to the ground surface, the light source module includes at least one LED chip, each of the LED chips has an optical axis, the optical axis is perpendicular to the vertical, in the cross section along the vertical direction and the optical axis, the reflective device includes a main reflective surface, it is difficult for the light to directly enter the eyes of the user, so that it can achieve the purpose of preventing glare.

10 Claims, 5 Drawing Sheets

LED STRIP LAMP LIGHT DISTRIBUTING SYSTEM HAVING A LIGHT SOURCE MODULE AND A REFLECTIVE DEVICE WITH VARIOUS CURVATURES FOR ILLUMINATING DIFFERENT SECTIONS OF AN ILLUMINATED SURFACE

CROSS-REFERENCE TO A RELATED APPLICATION

This application claims priority to a Chinese Patent Application No. CN 201710353968.6, filed on May 18, 2017.

FIELD OF THE TECHNOLOGY

The present invention relates to lighting equipment, with particular emphasis on a light distribution system of an LED strip lamp.

BACKGROUND

In general daily life, you can see all kinds of lighting equipment everywhere, for examples, fluorescent lamps, street lamps, table lamps, art lamps and so on. In the above lighting equipment, the incandescent light bulb has traditionally been used as a light source. In recent years, light-emitting diode (LED) has been utilized as light-emitting source due to the rapid advances in technology. In addition to lighting equipment, general traffic signs, billboards, lights, etc., are also replaced by the use of light-emitting diodes as a light source. As mentioned above, the use of light-emitting diodes as a light source has the advantages of power saving and greater brightness, and thus has become more and more common in use.

As shown in FIG. 1, it is a schematic diagram of an optical path of a lighting system using LED as a light source in the prior art. The lighting system includes an illuminated plane 1 and an LED light source 2 disposed on a side of the illuminated plane 1. The LED light source 2 includes a light-emitting surface 3, which emits numerous light rays 4 and illuminates the illuminated plane 1. It is conceivable that no matter where the LED light source 2 is placed on the illuminated plane 1, a part of the light rays 4 emitted by the light-emitting surface 3 will certainly be emitted toward the near side of the illuminated plane 1, while the other part will certainly emit toward the far side of the illuminated plane 1. It is because of the above unavoidable light irradiation structure that the light emitted toward the near side of the illuminated plane 1 will be attenuated relative to the light emitted toward the far side of the illuminated plane 1 regardless of whether the light is directed to the far side or the near side, light has the same initial luminance value, the brightness of the irradiated plane 1 differs from the distance of the LED light source 2, that is, the illumination intensity of the illuminated plane 1 is different.

This uneven lighting effect to some occasions, such as exhibition halls, showrooms, or some lighting in shopping malls, due to uneven lighting effects, that is, uneven illumination will be reduced to display items to visitors or purchase Visual effects, thereby reducing the visual impression of the quality of items displayed.

SUMMARY OF THE INVENTION

Therefore, it is necessary to provide a light distribution system of an LED strip lamp.

A light distribution system for an LED strip lamp comprises a light source module, a reflective device disposed in a light-emitting direction of the light source module, and an illuminated surface which receives the reflected light from the light reflective device, the illuminated surface includes a ground surface and a main illuminated surface perpendicular to the ground surface, the light source module includes at least one LED chip, each of the LED chips has an optical axis, the optical axis is perpendicular to the vertical, in the cross section along the vertical direction and the optical axis, the reflective device includes a main reflective surface, the main reflective surface includes one ground illumination section for illuminating the ground surface and one distal illumination section for illuminating farther away from the light source module and a proximal illumination section for illuminating the side closer to the light source module, the optical axis intersects with the outline of the distal illumination section, the ground illumination section includes the first curvature, the distal illumination section includes the second curvature, the proximal illumination section includes the third curvature, the first curvature is greater than the second curvature, and the second curvature is greater than the third curvature.

Advantageously, the light distribution system of the LED strip lamp comprises a lamp holder, the lamp holder includes a groove-shaped light source setting bit, and the groove-shaped light source setting bit includes at least one side wall.

Advantageously, the optical axis is perpendicular to the side wall.

Advantageously, the side wall is parallel to the vertical direction.

Advantageously, in the cross section parallel to the vertical direction and perpendicular to the optical axis, the reflective device further includes two auxiliary reflective surfaces respectively disposed on two sides of the optical axis.

Advantageously, the auxiliary reflective surface is a flat surface.

Advantageously, the reflected light of the auxiliary reflective surface is directed towards the distal illumination section or/and the proximal illumination section.

Advantageously, in a cross section parallel to the vertical direction and perpendicular to the optical axis, and in the light emitting direction along the LED chip, the angle between the outline of the auxiliary reflective surface and the optical axis is sharp angle.

Advantageously, the distance from the two ends of the projection line of the outline of the auxiliary reflective surface on the plane to the optical axis is equal on the plane along the vertical direction and the optical axis.

Advantageously, the outline of the ground illumination section, the distal illumination section and the proximal illumination section is a smooth curve in the cross section along the vertical direction and the optical axis.

Compared with the prior art, the light source module of the light distribution system of the LED strip lamp of the present invention is disposed on the side wall of the lamp holder, it is difficult for the light to directly enter the eyes of the user, so that it can achieve the purpose of preventing glare. Due to the reflection of the light emitted by the light source module by the reflective device and under the cooperation of the distal illumination section and the proximal illumination section of the reflective device, the main illuminated surface can be given substantially the same illumination in its vertical direction, which can greatly improve the user's light experience, increase the user's desire to shop.

DETAILED DESCRIPTION OF THE DRAWINGS

The drawings described herein are intended to promote a further understanding of the present invention, as follows.

DESCRIPTION OF THE PREFERRED EMBODIMENTS

The present application is illustrated by way of the following detailed description based on of the accompanying drawings. It should be noted that illustration to the embodiment in this application is not intended to limit the invention.

Figure 1:
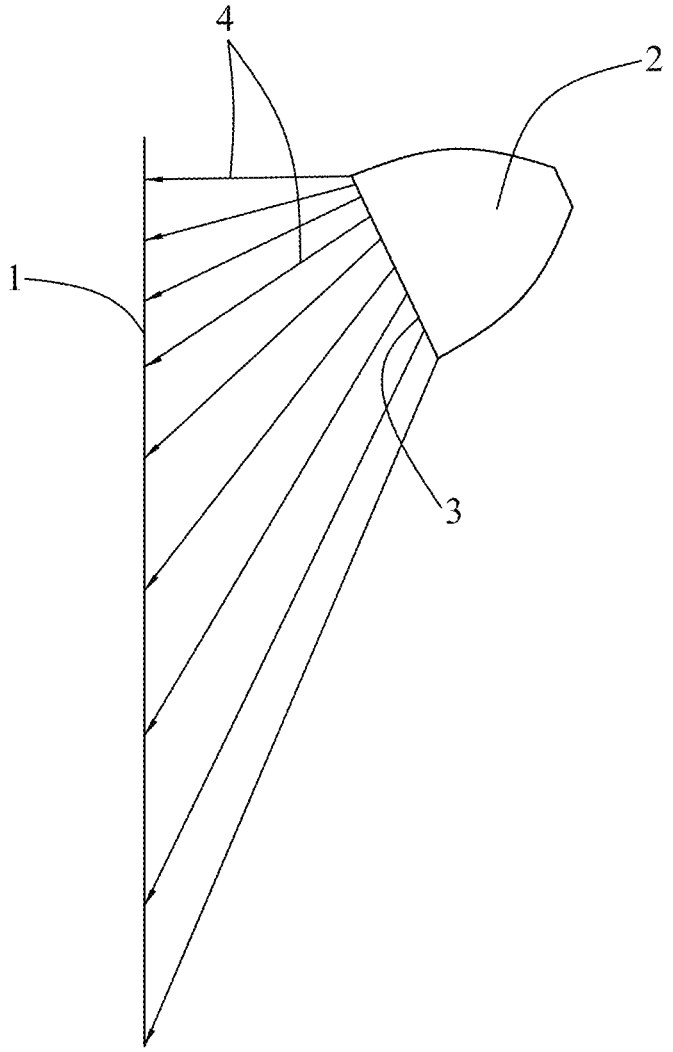
Prior Art FIG. 1
FIG. 1 is a schematic view of an optical path of a lamp lighting system in the prior art
Figure 2:
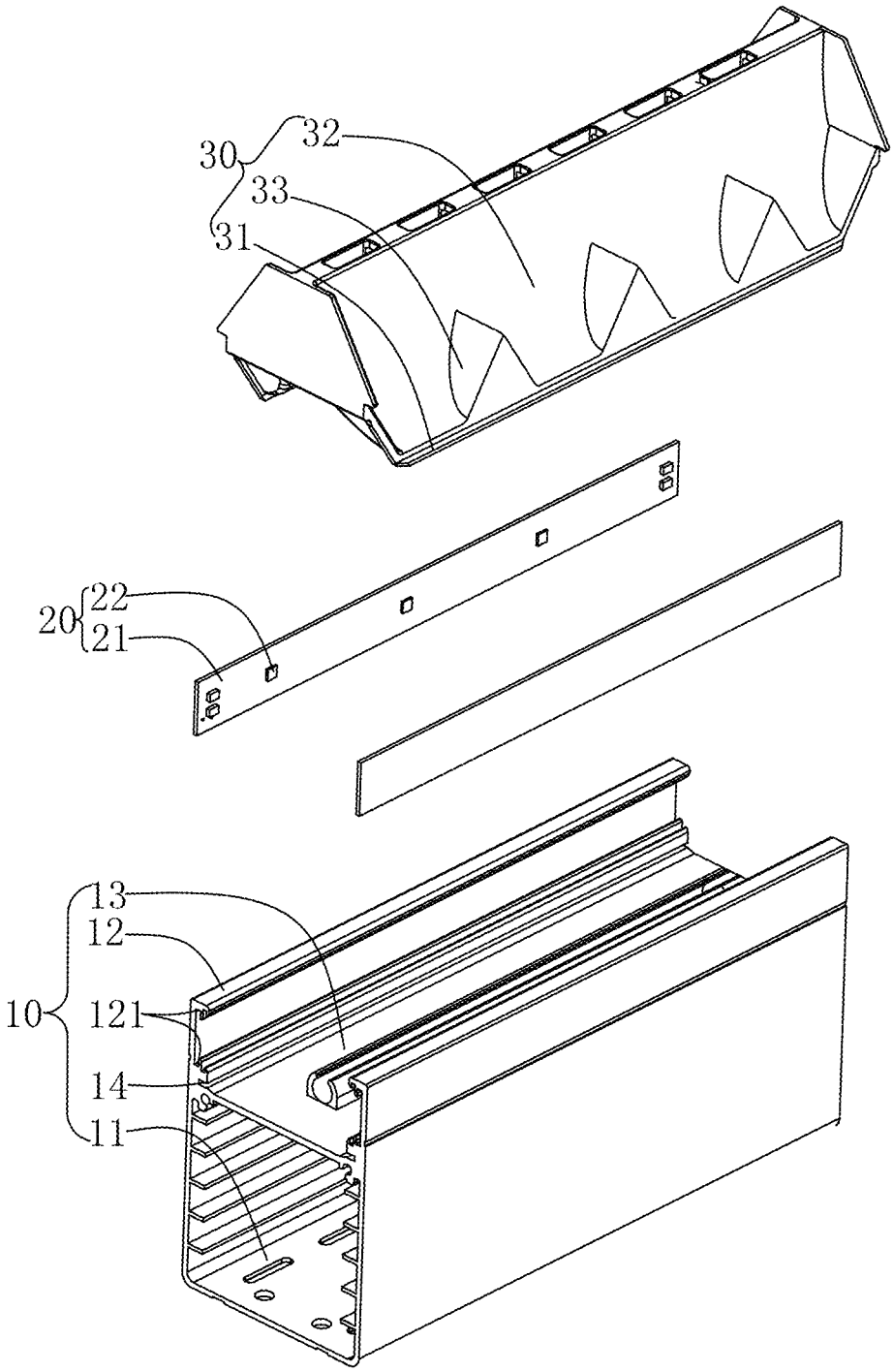
FIG. 2 is a schematic structural view of an LED strip lamp with a light distribution system provided by the present invention.
Figure 3:
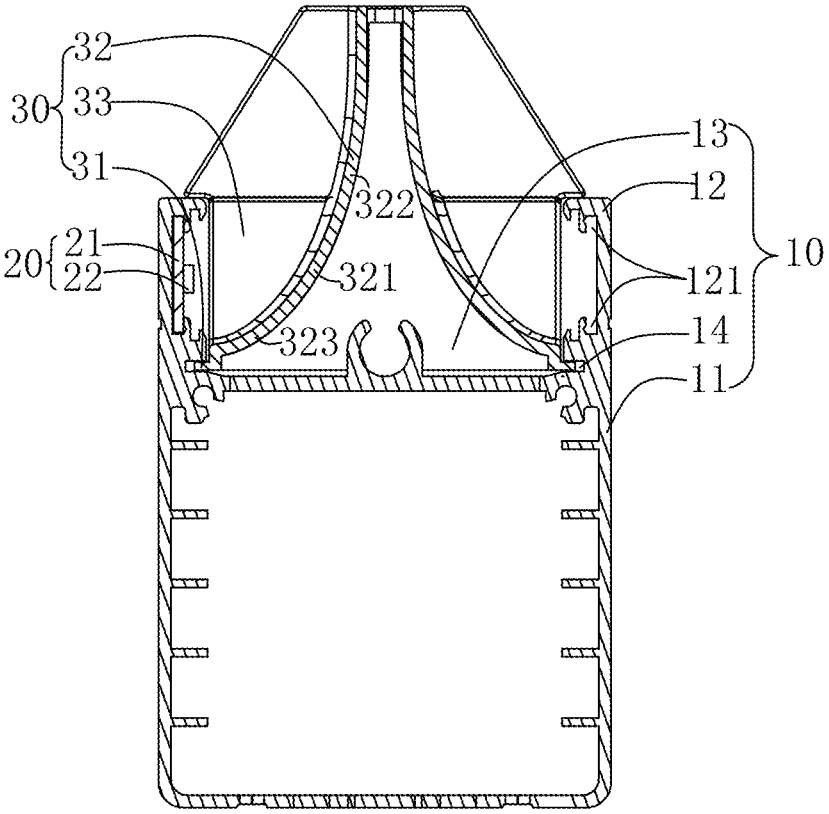
FIG. 3 is a schematic cross-sectional view of an LED strip lamp of FIG. 2.
Figure 4:
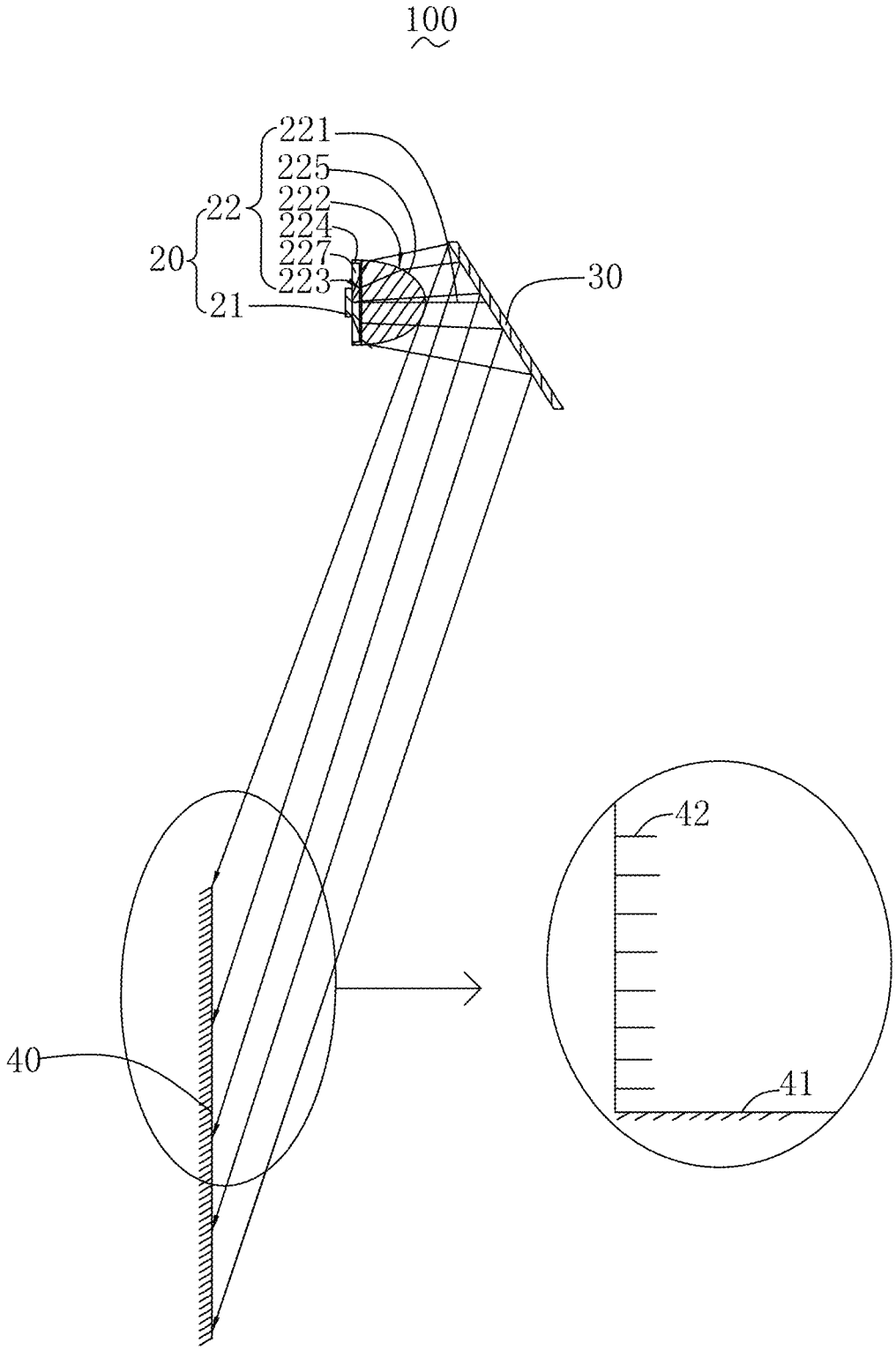
FIG. 4 is a schematic view of an optical path of a light distribution system of an LED lamp of FIG. 2.
Figure 5:
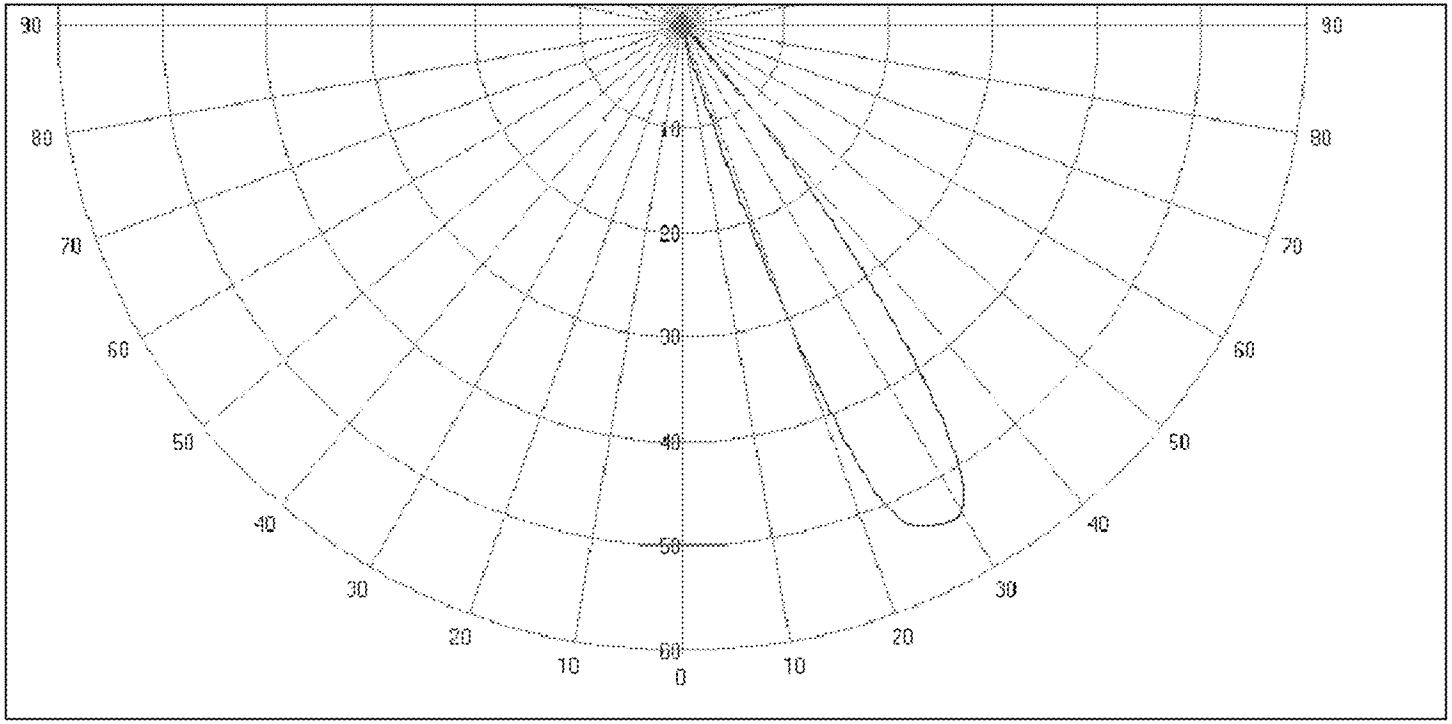
FIG. 5 is a light intensity diagram of a light distribution system of an LED lamp of FIG. 2.

Please refer to FIG. 2 to FIG. 4, which are a schematic block diagram and an application circuit diagram of a light distribution system of an LED strip lamp provided by the present invention. The light distribution system 100 of the LED strip lamp comprises a lamp holder 10, a light source module 20 disposed on the lamp holder 10, a reflective device 30 disposed in a light-emitting direction of the light source module 20, and an illuminated surface 40 which receives the reflected light from the light reflective device 30. It can be understood that the LED strip lamp further includes other functional modules, such as a power supply module for supplying power to the light source module 20, an end cover disposed on both ends of the lamp holder 10, a track plug, and the like, which are well-known to those skilled in the art and will not be repeated here.

The illuminated surface 40 may include a shelf in a warehouse or a shopping mall, a wall in a museum or an exhibition hall, or a front row of goods such as a freezer. Although the aforementioned light environment can not be an absolute plane, in the present invention, for the sake of simplification of description, it is true that in the actual optical design, the aforementioned light environment is simulated as a single plane for light distribution design. Therefore, in the drawings, only one line is used instead of the light environment. In the optical design, a reference is necessarily required to configure the propagation path of the light. Therefore, in this embodiment, the illuminated surface 40 includes a vertical direction. The vertical direction of the illuminated surface 40 serves as one dimension of the light distribution system 100. The illuminated surface 40 includes a ground surface 41 and a main illuminated surface 42 perpendicular to the ground surface 41. In actual use, the ground surface 41 can be an aisle between shelves, a hallway, or the like. Due to the pedestrian walking in it, some light sources are also needed. The main illuminated surface 42 may be the aforementioned shelf, wall surface, or front row of goods and so on. It can be understood that the main illuminated surface 42 serves as a plane which is parallel or coincident with the vertical direction.

The lamp holder 10 may be strip-shaped and includes a base 11 and two side walls 12 respectively extending from the base 11. The two side walls 12 are spaced apart to form a groove-shaped light source setting bit 13. The lamp holder 10 may be made of metal to facilitate heat dissipation, and the manufacturing method thereof may be extrusion molding. It is conceivable that other functional modules, such as a power module, a track plug, and the like, are further disposed on the lamp holder 10. Each of the sidewalls 12 defines two first slots 121 spaced apart from each other. The two first slots 121 are configured to dispose the light source module 20. A second slot 14 is defined in each of the two sidewalls 12 near the bottom of the base 11. The two second slots 14 are used for inserting the reflective device 30. When installing the LED strip lamp, a track or a sling is usually arranged on a ceiling of a building, and then the rail plug is hung on the track or suspended by other hardware sling, so as to achieve the purpose of installing the LED strip lamp.

The light source module 20 includes a circuit board 21 and at least one LED chip 22. The circuit board 21 is inserted into the two first slots 121 of the side wall 12 of the lamp holder 10 to fix the light source module 20 in the lamp holder 10. It is conceivable that since the lamp holder 10 has two side walls 12, there are two light source module 20 inserted on two of the side walls 12. The circuit board 21 is well-known to those skilled in the art. Needless to say, the circuit board 21 is used to provide various electronic components, such as resistors, capacitors, and LED chips 22, and electrically connect the electronic components. The LED chip 22 is a solid-state semiconductor device which is capable of converting electrical energy into visible light, that is, it can directly convert electricity into light energy. The related technologies on LEDs are well-known to those skilled in the art and will not be repeated here. Each of LED chips 22 has an optical axis 221, i.e. the central axis of the LED chip 22, which serves as a guide for optical design. The optical axis 221 is perpendicular to the side wall 12 and also perpendicular to the main illuminated surface 42 so that the optical axis 221 is also perpendicular to the vertical direction of the main illuminated surface 42. Then it become the second dimension of the position of the various components of the LED strip lamp, that is, the vertical direction of the main illuminated surface 42 forms a two-dimensional plane with the optical axis 221 so as to locate and explain other elements.

The reflective device 30 includes two strips 31 for inserting into the second slot 14 of the lamp holder 10, a main reflective surface 32, and two auxiliary reflective surfaces 33 respectively disposed on two sides of the main reflective surface 32. The manufacturing method of the reflective device 30 is well-known to those skilled in the art. The reflective device 30 may be injection-molded by a plastic injection molding machine according to need, and then a reflective material such as silver may be plated on the surface of the molded part. The strip 31 has a bar-shaped structure and is inserted into the second slot 14 to fix the reflective device 30. That is, the reflective device 30 is fixedly disposed in the lamp holder 10. In the cross section along the vertical direction and the optical axis 221, the main reflective surface 32 include one ground illumination section 321 for illuminating the ground surface 41 and one distal illumination section 322 for illuminating farther away from the light source module 20 and a proximal illumination section 323 for illuminating the side closer to the light source module 20. The ground illumination section 321 is disposed at a position close to the strip 31. The ground illumination section 321 is arc-shaped and includes the first curvature. The ground illumination section 321 receives the light of the LED chip 22 and reflects the light toward the ground surface 41, thereby illuminating the ground surface 41 to obtain a certain lumen light source for the ground surface 41. The distal illumination section 322 is connected to the ground illumination section 321, the optical axis 221 intersects with the outline of the distal illumination section 322 in a cross section along the vertical direction and the optical axis 221 so that the LED chip 22 emits a part of the light with the strongest light intensity around the optical axis 221 to the distal illumination section 322 and is reflected by the distal illumination section 322 to the side of the main illuminated surface 42 far from the light source module 20. The distal illumination section 322 is also arc-shaped and includes the second curvature. The value of the second curvature is less than the value of the first curvature. The proximal illumination section 323 is connected to the distal illumination section 322, that is, the distal illumination section 322 is disposed between the ground illumination section 321 and the proximal illumination section 323. The proximal illumination section 323 receives a part of light of the LED chip 22 below the optical axis 221 and is reflected by the proximal illumination section 323 and then emits to the side of the main illuminated surface 42 that is closer to the light source module 20. Since part of the light with the strongest light intensity around the optical axis 221 of the LED chip 22 is reflected and then emitted to the side of the main illuminated surface 42 farther away from the light source module 20 and a part of the light with stronger light intensity and weakest light after being reflected by the proximal illumination section 323 and directed to the side of the main illuminated surface 42 that is closer to the light source module 20, this can compensate for the greater loss of light caused by the reflected light from the distal illumination section 322 to the far distance and the reflected light from the proximal illumination section 323 to the near distance, and thus can make the illuminance of the main illuminated surface 42 is substantially the same as the distance from the light source module 20 and farther away. Here, it is necessary to explain the meaning of "substantially the same". "substantially the same" means that although the illuminance values may not be exactly the same with the illuminometer measuring the two sides of the main illuminated surface 42 far and near to the light source module 20, It is difficult to perceive the difference for the naked eye observation so that the lighting effect of the main illuminated plane 42 is consistent with the human vision. The proximal illumination section 323 is also arc-shaped and includes the third curvature, the third curvature having a value less than the second curvature. Meanwhile, with respect to the LED chip 22, the first, second, and third curvatures are all positive curvatures. In order to make the emitted light continuous, the outline of the ground illumination section 321, the distal illumination section 322 and the proximal illumination section 323 is a smooth curve in the cross section along the vertical direction and the optical axis 221.

Two of the auxiliary reflective surfaces 33 are in a section parallel to the vertical direction and perpendicular to the optical axis 221, and they are on two sides of the optical axis 221. Preferably, the two auxiliary reflective surfaces 33 are axisymmetric with respect to the optical axis 221. The reflected light of the auxiliary reflective surface 33 may be directed towards the distal illumination section 322 or/and the proximal illumination section 323 according to actual needs. For example, which section needs to be supplemented, let the reflected light of the auxiliary reflective surface 33 be directed to which section. In this embodiment, the auxiliary reflective surface 33 is a flat surface. Of course, it is also conceivable that the auxiliary reflective surface 33 can also be curved. In addition, in the cross section parallel to the vertical direction and perpendicular to the optical axis 221, and in the light emitting direction along the LED chip 22, the angle between the outline of the auxiliary reflective surface 33 and the optical axis 221 is sharp angle. At the same time, the distance from the two ends of the projection line of the outline of the auxiliary reflective surface 33 on the plane to the optical axis 221 is equal on the plane along the vertical direction and the optical axis 221.

It is conceivable that since the lamp holder 10 has two side walls 12, two light source modules 20 are disposed on the two side walls 12. The LED strip lamp therefore also has two reflective device 30. The two reflective devices 30 can be plane-symmetrically connected together, that is, integrally injection-molded.

Compared with the prior art, the light source module 20 of the light distribution system 100 of the LED strip lamp of the present invention is disposed on the side wall 12 of the lamp holder 10, it is difficult for the light to directly enter the eyes of the user, so that it can achieve the purpose of preventing glare. Due to the reflection of the light emitted by the light source module 20 by the reflective device 30 and under the cooperation of the distal illumination section 322 and the proximal illumination section 323 of the reflective device 30, the main illuminated surface 42 can be given substantially the same illumination in its vertical direction, which can greatly improve the user's light experience, increase the user's desire to shop.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. A light distribution system of an LED strip lamp, comprising:

a light source module, a reflective device disposed in a light-emitting direction of the light source module, and an illuminated surface which receives reflected light from the light reflective device, the illuminated surface includes a ground surface and a main illuminated surface perpendicular to the ground surface and defines a plane that is parallel or coincident with a vertical direction, wherein the light source module includes at least one LED chip, each of the LED chips has an optical axis and is mounted on a circuit board, the reflective device includes a main reflective surface, the main reflective surface includes one ground illumination section for illuminating the ground surface and one distal illumination section for illuminating farther away from the light source module and a proximal illumination section for illuminating closer to the light source module, the optical axis intersects with an outline of the distal illumination section, the ground illumination section includes a first curvature, the distal illumination section includes a second curvature, the proximal illumination section includes a third curvature, the first curvature is greater than the second curvature, and the second curvature is greater than the third curvature.

2. The light distribution system of an LED strip lamp as claimed in claim 1, wherein the light distribution system of the LED strip lamp comprises a lamp holder, the lamp holder includes a groove-shaped light source setting bit, and the groove-shaped light source setting bit includes at least one side wall.

3. The light distribution system of an LED strip lamp as claimed in claim 2, wherein the optical axis is perpendicular to the side wall.

4. The light distribution system of an LED strip lamp as claimed in claim 2, wherein the side wall is parallel to the vertical direction.

5. The light distribution system of an LED strip lamp as claimed in claim 1, wherein in a cross section parallel to the vertical direction and perpendicular to the optical axis, the reflective device further includes two auxiliary reflective surfaces respectively disposed on two sides of the optical axis.

6. The light distribution system of an LED strip lamp as claimed in claim 5, wherein the auxiliary reflective surface is a flat surface.

7. The light distribution system of an LED strip lamp as claimed in claim 5, wherein the reflected light of the auxiliary reflective surface is directed towards the distal illumination section or/and the proximal illumination section.

8. The light distribution system of an LED strip lamp as claimed in claim 5, wherein in a cross section parallel to the vertical direction and perpendicular to the optical axis, and in the light emitting direction along the LED chip, the angle between the outline of the auxiliary reflective surface and the optical axis is sharp angle.

9. The light distribution system of an LED strip lamp as claimed in claim 5, wherein the distance from two ends of the projection line of the outline of the auxiliary reflective surface on the plane to the optical axis is equal on the plane along the vertical direction and the optical axis.

10. The light distribution system of an LED strip lamp as claimed in claim 5, wherein the outline of the ground illumination section, the distal illumination section and the proximal illumination section is a smooth curve in the cross section along the vertical direction and the optical axis.

* * * * *